US007533695B2

(12) United States Patent
Strauss et al.

(10) Patent No.: US 7,533,695 B2
(45) Date of Patent: May 19, 2009

(54) CONTROL VALVE FOR A DEVICE CHANGING THE CONTROL TIMES OF AN INTERNAL COMBUSTION ENGINE

(75) Inventors: Andreas Strauss, Forchheim (DE); Andreas Röhr, Heroldsbach (DE); Jens Hoppe, Erlangen (DE)

(73) Assignee: Ina-Schaeffler KG (DE)

( * ) Notice: Subject to any disclaimer, the term of this patent is extended or adjusted under 35 U.S.C. 154(b) by 594 days.

(21) Appl. No.: 11/127,902

(22) Filed: May 12, 2005

(65) Prior Publication Data

US 2005/0252561 A1 Nov. 17, 2005

(30) Foreign Application Priority Data

May 14, 2004 (DE) ..... 10 2004 023 976
Aug. 6, 2004 (DE) ..... 10 2004 038 252

(51) Int. Cl.
*F15B 13/044* (2006.01)
*F01L 1/344* (2006.01)

(52) U.S. Cl. ..... 137/625.68; 123/90.17

(58) Field of Classification Search ..... 137/625.65, 137/625.68, 625.69; 123/90.17, 90.31
See application file for complete search history.

(56) References Cited

U.S. PATENT DOCUMENTS 2,876,796 A * 3/1959 Pool et al. ..... 137/625.68
3,596,560 A * 8/1971 Butterworth ..... 137/625.68
4,548,239 A * 10/1985 Eskildsen ..... 137/625.68
5,289,805 A * 3/1994 Quinn et al. ..... 123/90.17
5,669,343 A * 9/1997 Adachi ..... 123/90.17
5,878,782 A * 3/1999 Nakajima ..... 137/625.68
6,371,164 B2 * 4/2002 Sakata et al. ..... 137/625.69
7,069,951 B2 * 7/2006 Cornea ..... 137/625.68
2005/0056327 A1 3/2005 Daut et al. ..... 137/625.65
2006/0016495 A1 * 1/2006 Strauss et al. ..... 137/625.65

* cited by examiner

*Primary Examiner*—John Rivell
(74) *Attorney, Agent, or Firm*—Ostrolenk, Faber, Gerb & Soffen, LLP

(57) ABSTRACT

A control valve for a device for changing the control times of an internal combustion engine, having a substantially hollow-cylindrical valve housing, a control piston which is arranged within the valve housing and can be displaced axially, a pressure medium connection, two operating connections, and at least one tank connection. The operating connections, the pressure medium connection and the tank connection are formed as radial connections. It is possible for the operating connections to be connected to the pressure medium connection and the tank connection by axial displacement of the control piston within the valve housing. The operating connections are arranged adjacently.

7 Claims, 3 Drawing Sheets

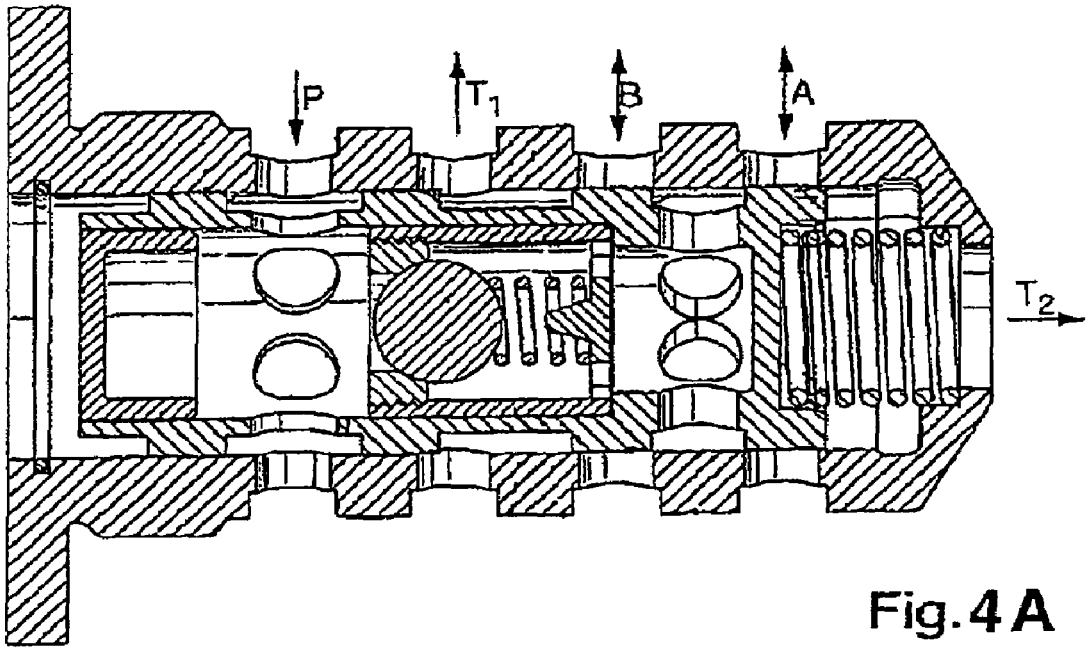
Fig.4A
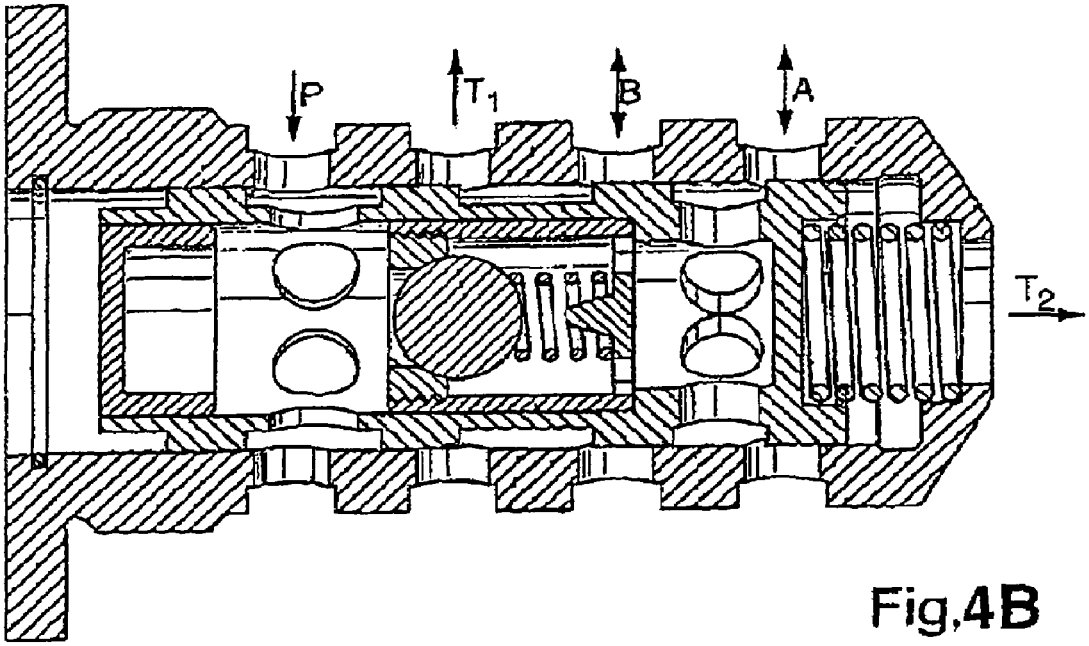
Fig,4B

CONTROL VALVE FOR A DEVICE CHANGING THE CONTROL TIMES OF AN INTERNAL COMBUSTION ENGINE

FIELD OF THE INVENTION

The invention relates to a control valve for a device for changing the control times of an internal combustion engine. The valve has a substantially hollow-cylindrical valve housing, a control piston which is arranged within the valve housing and can be displaced axially, and a pressure medium connection, two operating connections and at least one tank connection. The operating connections, the pressure medium connection and the tank connection are formed as radial connections. It is possible for the operating connections to be connected to the pressure medium connection and the tank connection by axial displacement of the control piston within the valve housing.

In internal combustion engines, camshafts are used to actuate the gas exchange valves. Camshafts are fitted in the internal combustion engine in such a way that cams fitted to them bear on cam followers, for example bucket tappets, drag levers or rocking levers. If a camshaft is set rotating, then the cams roll on the cam followers which, in turn, actuate the gas exchange valves. The opening duration and the opening amplitude, and also the opening and closing times, of the gas exchange valves are defined by the position and the shape of the cams.

Modern engine concepts are directed toward designing the valve drive to be variable. Firstly, the valve stroke and the valve opening period should be configured to be variable, as far as the complete shut-down of individual cylinders. For this purpose, concepts such as controllable cam followers or electrohydraulic or electric valve activations are provided. Furthermore, it has proven advantageous to be able to exert an influence on the opening and closing times of the gas exchange valves during the operation of the internal combustion engine. In this case, it is particularly desirable to be able to exert an influence on the opening and closing times of the inlet and outlet valves separately, in order, for example, to set a defined valve overlap specifically. By setting the opening and closing times of the gas exchange valves as a function of the current characteristic map region of the engine, for example, of the current rotational speed or the current load, the specific fuel consumption can be reduced, the exhaust gas behavior can be influenced positively, and the engine efficiency, the maximum torque and the maximum power can be increased.

The above described variability of the gas exchange valve control times is achieved by a relative change in the phase angle of the camshaft in relation to the crankshaft. In this case, the camshaft normally has a drive connection to the crankshaft via a chain, belt, gear drive or equivalent drive concepts. Fitted between the chain, belt or gear drive driven by the crankshaft and the camshaft is a device for changing the control times of an internal combustion engine, also called a camshaft adjuster in the following text, which transmits the torque from the crankshaft to the camshaft. In this case, this device is constructed in such a way that, during operation of the internal combustion engine, the phase angle between the crankshaft and the camshaft is maintained reliably and, if desired, the camshaft can be rotated over a specific angular range with respect to the crankshaft.

In internal combustion engines having a camshaft for each of the inlet and the outlet valves, these valves can each be equipped with a respective camshaft adjuster. As a result, the opening and closing times of the inlet and outlet gas exchange valves can be displaced relative to each other in time and the valve overlaps can be set specifically.

Modern camshaft adjusters are normally located at the drive end of the camshaft. However, the camshaft adjuster can also be arranged on an intermediate shaft, on a nonrotating component or on the crankshaft. The adjuster comprises a drive wheel driven by the crankshaft, and maintaining a fixed phase relationship with the crankshaft, an output drive part having a drive connection to the camshaft, and an adjusting mechanism transmitting the torque from the drive gear to the output drive part. The drive wheel can be designed as a chain, belt or gear in the case of a camshaft adjuster not arranged on the crankshaft, and is driven by the crankshaft by means of a chain, belt or gear drive. The adjusting mechanism can be operated electrically, hydraulically or pneumatically.

Two preferred embodiments of hydraulically adjustable camshaft adjusters are represented by what are known as axial piston adjusters and rotary piston adjusters.

In the case of axial piston adjusters, the drive wheel is connected to a piston which is connected to the output drive part, in each case via oblique toothing. The piston divides a hollow space formed by the output drive part and the drive wheel into two pressure chambers arranged axially in relation to each other. If one pressure chamber is pressurized with pressure medium while the other pressure chamber is connected to a tank, then the piston is displaced in the axial direction. The axial displacement of the piston is converted by the oblique toothing into a relative rotation of the drive gear in relation to the output drive part and therefore of the camshaft in relation to the crankshaft.

A second embodiment of hydraulic camshaft adjusters are known as rotary piston adjusters, in which the drive wheel is connected to a stator so as to be fixed against rotation. The stator and a rotor are arranged concentrically in relation to each other, and the rotor is connected by a form fit or a material connection, for example by means of a press fit, a screwed or welded connection, to a camshaft, an extension of the camshaft or an intermediate shaft. Cavities are formed in the stator, which are spaced apart in the peripheral direction and which, starting from the rotor, extend radially outward. The cavities are delimited in a pressure-tight manner in the axial direction by side covers. A vane extends into each cavity. It is connected to the rotor and divides each cavity into two pressure chambers. By specifically connecting the individual pressure chambers to a pressure medium pump or to a tank, the phase of the camshaft relative to the crankshaft can be set and maintained.

In order to control the camshaft adjuster, sensors register characteristic data of the engine, such as the load state and the rotational speed. This data is supplied to an electronic control unit which, after comparing the data with a characteristic map for the internal combustion engine, controls the supply and discharge of pressure medium to and from the various pressure chambers.

In order to adjust the phase angle of the camshaft with respect to the crankshaft, one of the two oppositely acting pressure chambers of a cavity in the hydraulic camshaft adjusters is connected to a pressure medium pump and the other to the tank. The supply of pressure medium to a chamber in conjunction with the discharge of pressure medium from the other chamber displaces the piston dividing the pressure chambers in the axial direction. In axial piston adjusters, this means that the camshaft is rotated relative to the crankshaft via the oblique toothing. In rotary piston adjusters, as a result of pressurizing one chamber and depressurizing the other chamber, displacement of the vane and therefore a rotation of the camshaft with respect to the crankshaft are effected directly. In order to maintain the phase angle, both pressure chambers are either connected to the pressure medium pump or isolated from both the pressure medium pump and from the tank.

Control of the pressure medium flows to and from the pressure chambers is carried out by a control valve, normally a 4/3 proportional valve. A valve housing is provided in each case with a connection for the pressure chambers (operating connection), a connection to the pressure medium pump and at least one connection to a tank. An axially displaceable control piston is arranged within the valve housing, which is substantially hollow-cylindrical. The control piston can be moved axially by an electromagnetic actuating element counter to the spring force of a spring element into any position between two defined end positions. The control piston is, moreover, provided with annular grooves and control edges. This means that the individual pressure chambers can optionally be connected to the pressure medium pump or to the tank. Likewise, it is possible to position of the control piston so that the pressure medium chambers are isolated both from the pressure medium pump and from the pressure medium tank.

A control valve of this type is illustrated in DE 102 15 939 C1. It substantially comprises an electromagnetic actuating drive, a hollow-cylindrical valve housing and a control piston which is likewise substantially hollow-cylindrical and can be displaced axially within the valve housing. The control piston can be displaced into any desired position within the valve housing by the actuating drive, which acts counter to the spring element.

Three annular grooves are introduced into the outer peripheral surface of the valve housing. The grooves are spaced axially in relation to one another. A plurality of radial openings opening into the interior of the valve housing are machined into the grooves. Each annular groove, together with its corresponding radial openings, forms a radial connection. The hollow-cylindrical control piston is provided on its outer peripheral surface with an annular groove. In each case two adjacent connections are able to communicate with each other by means of this annular groove, depending on the position of the control piston relative to the valve housing. Furthermore, a fourth connection running in the axial direction is provided. The geometry of the control piston makes it necessary in the present case that the outer radial connections, as seen in the axial direction of the control valve, be used as operating connections, while the central connection is used as a pressure medium or tank connection.

In this embodiment, the fact that additional components, such as filters or nonreturn valves, can be integrated within the control piston, between the pressure medium connection and the operating connections, only with difficulty, is disadvantageous. Furthermore, in each case two of these components have to be used, which leads to higher overall costs and to an increased weight of the apparatus. This type of valve is unsuitable specifically for the use as a central valve, in which the control valve is arranged within a central bore of the output drive part of a camshaft adjuster because the pressure medium supply and pressure medium discharge to the pressure medium connection and the tank connection, respectively, have to be carried out through the output drive part. This results in additional costs during production of this component. Furthermore, as a result of the arrangement of the pressure medium connection and of the tank connection between the operating connections, the minimum axial overall length of the camshaft adjuster is unnecessarily enlarged.

SUMMARY OF THE INVENTION

The invention is therefore based on the object of avoiding these outlined disadvantages and thus providing a hydraulic control valve, wherein it is possible to easily integrate additional components within the control valve and wherein, in an embodiment as a central valve, it does not have a detrimental effect on the costs or on the overall axial space of the camshaft adjuster.

According to the invention, this object is achieved in that, in the axial direction of the control valve, the connections are arranged in the sequence of pressure medium connection, tank connection, operating connection, and operating connection.

In an alternative embodiment, in the axial direction of the control valve, the connections are arranged in the sequence of tank connection, pressure medium connection, operating connection, and operating connection.

As a result of designing the control valve with immediately adjacent operating connections and tank and pressure medium connections adjacent axially thereto, the camshaft adjuster can be formed in such that, in the axial direction, it extends only in the region of the two operating connections, so that the overall axial space of the camshaft adjuster can be reduced to a minimum.

Since the tank and the pressure medium connection are thus arranged outside the camshaft adjuster, complicated feed and discharge of the pressure medium through the output drive part of the camshaft adjuster is unnecessary, which means that the camshaft adjuster can be fabricated more economically.

In an advantageous development of the invention, the control piston is hollow. The pressure medium connection communicates with the interior of the control piston, via two openings which are introduced into the peripheral surface of the control piston, in any position of the control piston relative to the valve housing. Furthermore, depending on the position of the control piston in relation to the valve housing, either one or none of the operating connections communicates with the interior of the control piston or one of the operating connections or both operating connections communicates with the interior of the control piston.

In this arrangement, pressure medium is led into the interior of the control piston via the pressure medium connection and the second openings and, from there, depending on the position of the control piston relative to the valve housing, reaches the operating connections arranged axially one after another. Components, such as nonreturn valves between the operating connections and the pressure medium connection or filters between the pressure medium connection and the operating connections, can be arranged in the overall space within the control piston, between the connections, in each case only one component having to be arranged in order to become active for both operating connections.

In an advantageous development of the invention, a nonreturn valve is arranged between the pressure medium connection and the operating connections. During the operation of the internal combustion engine, the hydraulic system of the camshaft adjuster is subjected to high pressure pulsations, on account of the alternating moments from the camshaft. These pressure peaks can lead to damage to the pressure medium pump or other components of the belt or chain drive. In order to prevent these pressure peaks being introduced into the hydraulic system of the internal combustion engine, a nonreturn valve is arranged between the operating connections and the pressure medium connection of the valve. This arrangement is specifically suitable for camshaft adjusters with a central valve, since this position of the nonreturn valve is at the smallest possible distance from the point at which the pressure pulsations arise.

Arrangement of the nonreturn valve within the control valve increases the torsional rigidity of the adjuster and therefore its positional stability.

BRIEF DESCRIPTION OF THE DRAWINGS

Other objects and features of the invention are seen in the following description and from the accompanying drawings, in which exemplary embodiments of the invention are illustrated in simplified form and in which:

FIG. 4A is a schematic illustration showing a central position of the control valve, according to an aspect of the present invention.

FIG. 4B is a schematic illustration of a fully energized state of the control valve according to an aspect of the present invention.

DETAILED DESCRIPTION OF A PREFERRED EMBODIMENT

Figure 1:
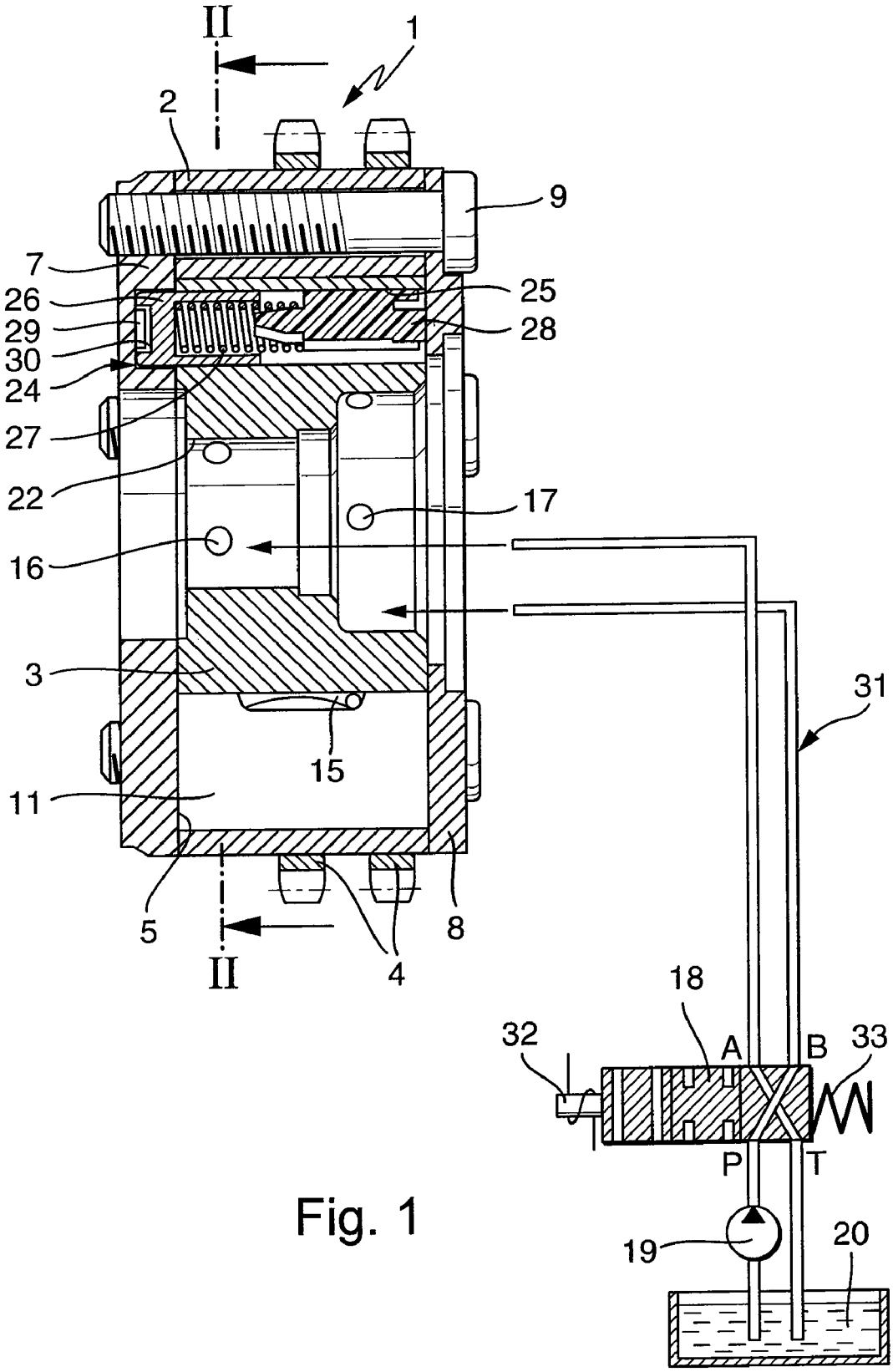
FIG. 1 shows a longitudinal section through a device for changing the control times of an internal combustion engine, with a pressure medium circuit.
Figure 2:
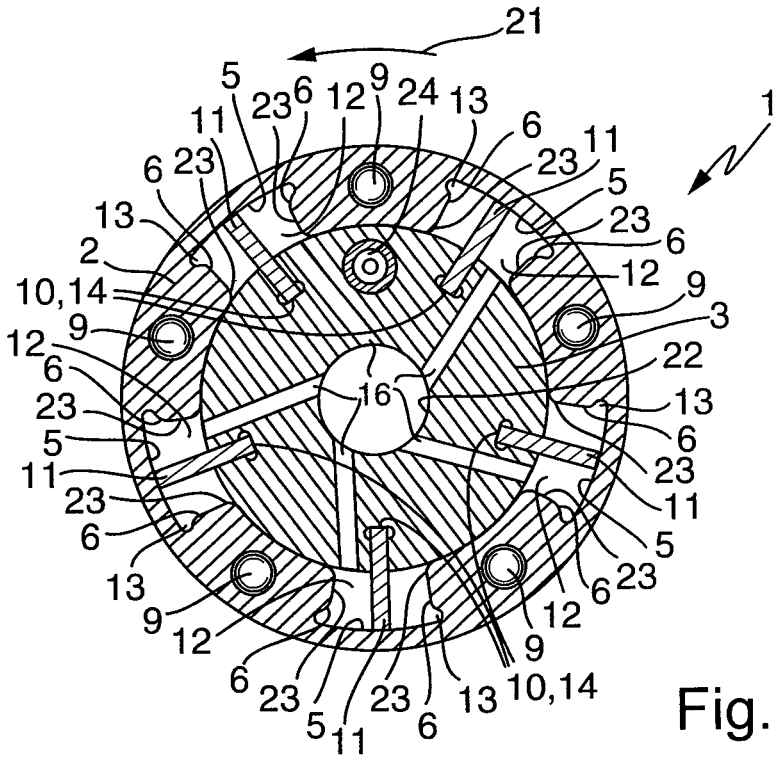
FIG. 2 shows a cross section through the device illustrated in FIG. 1 along the line II-II.

FIGS. 1 and 2 show a device 1 for changing the control times of an internal combustion engine. The device 1 substantially comprises a stator 2 and a rotor 3 arranged concentrically thereto. A drive wheel 4 is firmly connected to the stator 2 so as to rotate with it and, in the embodiment illustrated, is formed as a chain wheel. Embodiments of the drive wheel 4 as a belt or gear are likewise conceivable. The stator 2 is mounted on the rotor 3 such that the rotor can rotate with respect to the stator. Five recesses 5 spaced apart in the peripheral direction are provided on the inner peripheral surface of the stator 2 in the embodiment illustrated. The recesses 5 are delimited in the radial direction by the stator 2 and the rotor 3, in the peripheral direction by two side walls 6 of the stator 2 and in the axial direction by first and second side covers 7, 8. Each of the recesses 5 is closed in a pressure-tight manner in this way. The first and the second side covers 7, 8 are connected to the stator 2 by connecting elements 9, for example, screws.

Vane grooves 10 running axially are formed on the outer peripheral surface of the rotor 3. A respective vane 11 extending radially is arranged in each vane groove 10. A respective vane 11 extends into each recess 5, wherein the vanes 11 bear on the stator 2 in the radial direction and on the side covers 7, 8 in the axial direction. Each vane 11 subdivides its respective recess 5 into two pressure chambers 12, 13 which operate oppositely to each other. In order to ensure pressure-tight contact between the vanes 11 and the stator 2, leaf spring elements 15 are fitted between the bases 14 of the vane grooves 10 and the vanes 11, and the springs act on the vane 11 with a force in the radial direction.

Axially spaced apart first and second pressure medium lines 16, 17 can connect the first and second pressure chambers 12, 13 via a control valve 18 to a pressure medium pump 19 or a tank 20. This forms an actuating drive, which permits relative rotation of the stator 2 with respect to the rotor 3. Here, provision is made for either all the first pressure chambers 12 to be connected to the pressure medium pump 19 and all the second pressure chambers 13 to be connected to the tank 20 or, respectively, the exactly opposite configuration. If the first pressure chambers 12 are connected to the pressure medium pump 19 and the second pressure chambers 13 are connected to the tank 20, then the first pressure chambers 12 expand while the second pressure chambers 13 contract. This causes displacement of the vanes 11 in the peripheral direction, in the direction illustrated by the arrow 21. The displacement of the vanes 11 rotates the rotor 3 relative to the stator 2.

In the embodiment illustrated, the stator 2 is driven from the crankshaft by a chain drive that acts on its drive wheel 4, but is not illustrated. Driving the stator 2 by means of a belt or gear drive is likewise conceivable. The rotor 3 is connected to a camshaft, not illustrated, with a form fit, a force fit or a material connection, for example of a press fit or of a screw connection by means of a central screw. The rotation of the rotor 3 relative to the stator 2, resulting from supplying and discharging pressure medium to and from the pressure chambers 12, 13, causes a phase shift between the camshaft and the crankshaft. By specifically leading pressure medium into and out of the pressure chambers 12, 13, the control times of the gas exchange valves of the internal combustion engine can thus be varied in a specific way.

In the embodiment illustrated, the pressure medium lines 16, 17 are formed as bores arranged substantially radially, which extend from a central bore 22 of the rotor 3 to the outer peripheral surface of the rotor. Within the central bore 22, a central valve (not illustrated) can be arranged, via which the pressure chambers 12, 13 can be connected specifically to the pressure medium pump 19 or to the tank 20. A further possibility is to arrange a pressure medium distributor within the central bore 22, which connects the pressure medium lines 16, 17 via pressure medium ducts and annular grooves to the connections of a control valve 18 fitted externally.

The substantially radially extending side walls 6 of the recesses 5 are provided with moldings 23 which reach into the recesses 5 in the peripheral direction. The moldings 23 serve as stops for the vanes 11 and ensure that the pressure chambers 12, 13 can be supplied with pressure medium even if the rotor 3 assumes one of its two extreme positions relative to the stator 2, in which the vanes 11 bear on one of the side walls 6.

In the event there is an insufficient pressure medium supply to the device 1, for example, during the starting phase of the internal combustion engine, the rotor 3 may move in an uncontrolled manner relative to the stator 2 on account of the alternating and dragging moments which the camshaft exerts on the rotor. In a first phase, the dragging moments of the camshaft force the rotor relative to the stator in a peripheral direction which is opposite to the direction of rotation of the stator, until the vanes strike the side walls 6. The alternating moments exerted on the rotor 3 by the camshaft then lead to the rotor 3 oscillating to and fro causing the vanes 11 to oscillate to and fro in the recesses 5 until at least one of the pressure chambers 12, 13 is completely filled with pressure medium. This leads to relatively high wear and to the development of noise in the device 1. To prevent this, a locking element 24 is provided in the device 1. For this purpose, a pot-shaped piston 26 is arranged in an axial bore 25 in the rotor 3 and is acted on with a force in the axial direction by a spring 27. The spring 27 is supported in the axial direction at one end on a venting element 28 and, at its axial end facing away therefrom, is arranged within the pot-shaped piston 26. A slotted guide 29 is formed in the first side cover 7, such that the rotor 3 can be locked relative to the stator 2 in a position which corresponds to the position during starting of the internal combustion engine. In this position, in the event of an inadequate pressure medium supply to the device 1, the piston 26 is forced into the slotted guide 29 by means of the spring 27. Means also force the piston 26 back into the axial bore 25 when there is an adequate supply of pressure medium to the device 1, thereby to cancel the locking. This is normally brought about with pressure medium which, via pressure medium lines that are not illustrated, is led into a cutout 30 which is formed at the cover-side front end of the piston 26. In order to be able to discharge leakage oil from the spring chamber of the axial bore 25, the venting element 28 is provided with grooves running axially, along which the pressure medium can be led to a bore in the second side cover 8.

The pressure medium circuit 31 is additionally illustrated in FIG. 1. From a tank 20, a pressure medium connection P of a control valve 18 is supplied with pressure medium by means of a pressure medium pump 19. At the same time, pressure medium is led into the tank 20 from the control valve 18 via a tank connection T. The control valve 18 also has two operating connections A, B. An electromagnetic actuating element 32, which acts counter to the spring force of a first spring element 33, to move the control valve 18 into three positions. In a first position of the control valve 18, which corresponds to an unenergized state of the actuating element 32, the operating connection A is connected to the tank connection T and the pressure medium connection P is connected to the operating connection B and thus to the second pressure chamber 13. In a central position, as illustrated in FIG. 4A, both the operating connection A and the operating connection B are isolated both from the pressure medium connection P and from the tank connection T. In a third position of the control valve 18, as shown in FIG. 4B, the pressure medium connection P is connected to the operating connection A and consequently to the first pressure chamber 12, while the second pressure chamber 13 is connected to the tank connection T via the operating connection B.

Figure 3:
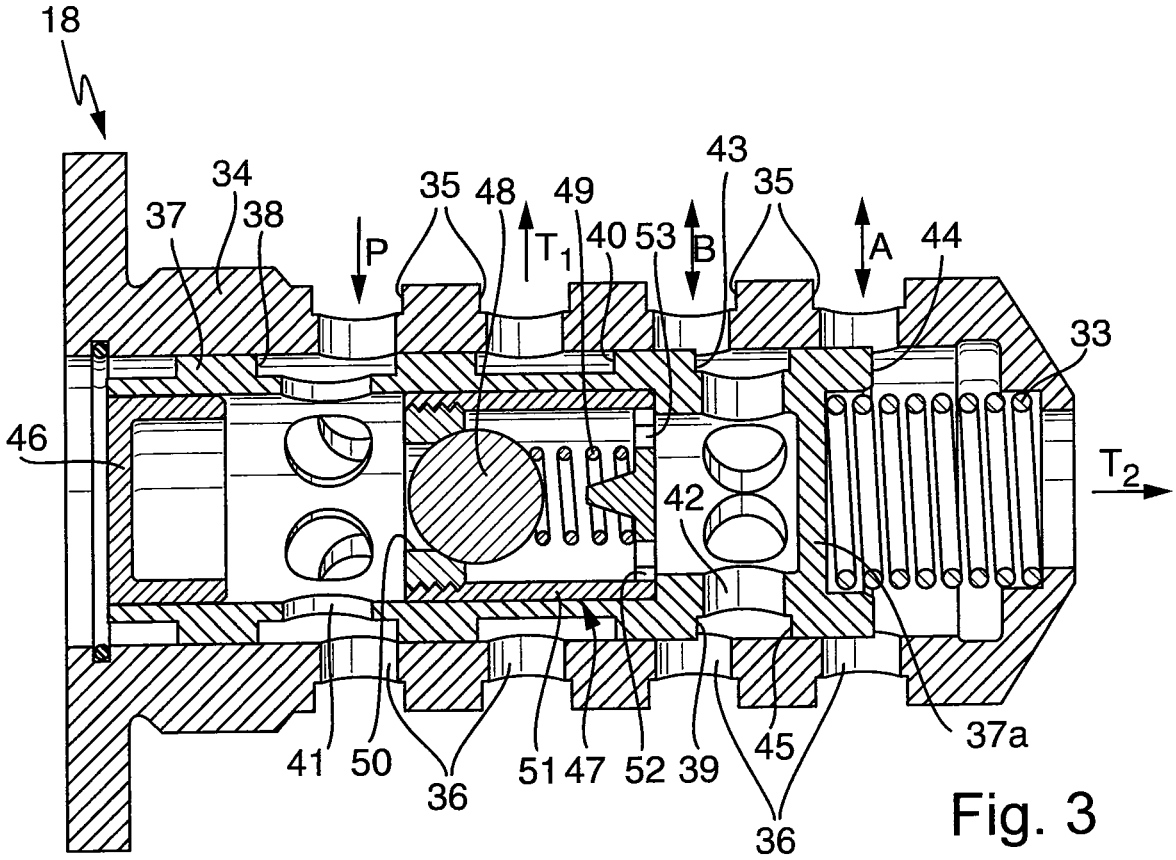
FIG. 3 shows a longitudinal section through a control valve according to the invention.

In FIG. 3, a control valve 18 according to the invention is illustrated in longitudinal section. The substantially hollow-cylindrical valve housing 34 is provided with a radial pressure medium connection P, a radial tank connection T1, two operating connections A, B and an axial tank connection T2. The radial connections P, T1, A, B are formed as first annular grooves 35 which are spaced apart axially from one another and which are introduced into the outer peripheral surface of the valve housing 34. The first annular grooves 35 are provided with a plurality of first openings 36, which open into the interior of the valve housing 34. Within the valve housing 34, a control piston 37, likewise substantially hollow-cylindrical, is arranged such that it can be displaced axially. One axial end of the control piston is delimited in a pressure-tight manner by means of a wall section 37*a*. The wall section 37*a* can be in one piece with the control piston or separately from the latter. An actuating element 32, not illustrated in FIG. 3, can move the control piston 37 into any desired position within two extreme values and can hold the piston, counter to the spring force of the first spring element 33.

The outer peripheral surface of the control piston 37 is provided with a second, a third and a fourth annular groove 38, 39, 40. The second and the third annular grooves 38, 39 communicate with the interior of the control piston 37 via second and third openings 41, 42. The second annular groove 38 is formed in such a way that, in every position of the control piston 37 relative to the valve housing 34, it communicates with the first openings 36 of the first annular groove 35 of the pressure medium connection P.

During the operation of the internal combustion engine, pressure medium from the pressure medium connection P passes into the interior of the control piston 37 via the second annular groove 38 and the second openings 41. In the first position of the control piston 37, illustrated in FIG. 3, the pressure medium reaches the operating connection B via the third openings 42 and the third annular groove 39. As a result of applying pressure medium to the second pressure chambers 13 via the operating connection B, pressure medium is forced out of the second pressure chambers 12 to the operating connection A and, via its first openings 36, reaches the axially arranged tank connection T2.

If the electromagnetic actuating element 32 is energized, the control piston 37 is displaced counter to the spring force of the first spring element 33. Consequently, the coverage of the first openings 36 of the operating connection B by a first control edge 43 of the third annular groove 39 increases. To the same extent, the coverage of the first openings 36 of the operating connection A by a second control edge 44 of the control piston 37 also increases. When the control piston 37 reaches a central position, not illustrated, the operating connection A is no longer connected to the axial tank connection $T_2$, because of complete coverage of the second control edge 44. Furthermore, neither the operating connection A nor the operating connection B communicates with the third annular groove 39.

Alternatively, the control piston 37 can be designed in such a way that, in the central position, both operating connections A, B communicate with the third annular groove 39.

If the control piston 37 is displaced further counter to the spring force of the first spring element 33, a third control edge 45 opens the first openings 36 of the operating connection A toward the third annular groove 39. Pressure medium flowing in from the pressure medium connection P then reaches only the operating connection A. At the same time, the fourth annular groove 40 communicates both with the operating connection B and with the radial tank connection T1. In this way, pressure medium from the pressure medium pump 19 reaches the first pressure chambers 12, which leads to relative rotation of the rotor 3 in relation to the stator 2. The pressure medium forced out of the second pressure chambers 13 reaches the radial tank connection $T_1$ via the operating connection B and the fourth annular groove 40. The third control edge 45 and the fourth annular groove 40 can be designed in such a way that, during the displacement of the control piston 37, first of all the operating connection A is connected to the pressure medium pump 19 and then the operating connection B is connected to the tank 20. Alternatively, both connections can also be produced simultaneously.

At its axial end facing away from the wall section 37*a*, the control piston 37 is closed in a pressure-tight manner by a pot-shaped sleeve 46. The latter is fixed in the interior of the control piston 37 by a force fit. The sleeve 46 also serves as a point of action for a push rod, not illustrated, belonging to the actuating element 32.

During the operation of the internal combustion engine, pressure pulsations are generated within the device 1 because of the alternating moments of the camshaft. Pressure peaks therefore occur, which are transmitted into the pressure medium circuit 31 and can damage other loads. This can be suppressed by the arrangement of a nonreturn valve 47 in the pressure medium circuit 31.

In one embodiment of the control valve 37, the nonreturn valve 47 is arranged between the operating connections A, B and the pressure medium connection P. The axial arrangement of the connections in the order P-T-A-B or T-P-A-B, the order of the operating connections A, B being arbitrary, permits the arrangement of a nonreturn valve 47 within the control piston 37. In this case, only one nonreturn valve 47 is needed to protect the pressure medium circuit 31. Arrangement of the nonreturn valve 47 inside the control piston 37 avoids need for additional overall space. A further advantage is that, in particular when the control valve 18 is used as a central valve, the distance between the location at which the pressure pulsations arise and the nonreturn valve 47 is minimal. Pressure fluctuations are intercepted virtually at the location at which they arise.

The nonreturn valve 47 comprises a spring-loaded shut-off element 48, which is forced into a seat 50 of the nonreturn valve 47 by a second spring element 49. The shut-off element 48, the second spring element 49 and the seat 50 are arranged within a pot-shaped housing 51. The second spring element 49 is supported on the base of the housing 51.

During mounting, the nonreturn valve 47 is pressed into the interior of the control piston 37. Here, the components are formed in such a way that a pressure-tight, force-fitting connection between the inner peripheral surface of the control piston 37 and the housing 51 is produced. In this case, it is advantageous to form an axial stop 52 within the control piston 37, which serves as a stop as the nonreturn valve 47 is pressed into the control piston 37. Alternatively, the nonreturn valve 47 can be pressed in with control of the travel.

Pressure medium flowing in from the pressure connection P passes via the second openings 41 into the interior of the control piston 37. Beginning at a certain pressure, the shut-off element 48 is displaced counter to the spring force of the second spring element 49 and the pressure medium reaches the third openings 42 via fourth openings 53, which are introduced into the base of the housing.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A control valve for a device for changing control times of an internal combustion engine, the control valve comprising:

a hollow-cylindrical valve housing having an axial side and a radial side with an outer surface and an inner surface, the inner surface defining a piston movement path;

a control piston positioned within the valve housing and displaceable axially in the piston movement path of the valve housing;

a pressure medium connection;

two operating connections;

at least one radial tank connection;

the two operating connections, the pressure medium connection and the at least one radial tank connection each being formed as respective radial connections on the radial side, each radial connection communicating with an interior of the valve housing via radially extending through-holes only formed in the valve housing, each through-hole of the radially extending through-holes having only two openings, a first opening of the two openings positioned at the outer surface of the valve housing and a second opening of the two openings positioned at the inner surface of the valve housing;

the valve housing including an axial tank connection positioned on the axial side of the valve housing, the axial tank connection positioned on a side of the operating connections opposite from the radial tank connection, wherein the control piston is configured such that due to axial displacement of the control piston within the valve housing the control piston is positioned such that the control valve connects the two operating connections to the pressure medium connection and/or the radial tank connection, or isolates the two operating connections from both the pressure medium connection and the radial tank connection, wherein in an axial direction of the control valve, the radial connections are arranged in sequence: pressure medium connection, radial tank connection, and the two operating connections.

2. The control valve as claimed in claim 1, wherein the control piston is hollow.

3. The control valve as claimed in claim 2, wherein the control piston has a peripheral surface with two openings and an interior space, wherein the pressure medium connection communicates with the interior space of the control piston in any position of the control piston relative to the valve housing via the two openings in the peripheral surface of the control piston.

4. The control valve as claimed in claim 3, wherein, depending on the position of the control piston in relation to the valve housing, exactly one or none of the two operating connections communicates with the interior space of the control piston.

5. The control valve as claimed in claim 3, wherein, depending on the position of the control piston in relation to the valve housing, one of the two operating connections or both of the two operating connections communicates with the interior space of the control piston.

6. The control valve as claimed in claim 2, further comprising a nonreturn valve arranged between the pressure medium connection and the two operating connections.

7. The control valve as claimed in claim 1, wherein each of the through-holes are provided along a straight line in the valve housing.

* * * * *

UNITED STATES PATENT AND TRADEMARK OFFICE

CERTIFICATE OF CORRECTION

PATENT NO. : 7,533,695 B2
APPLICATION NO. : 11/127902
DATED : May 19, 2009
INVENTOR(S) : Strauss et al.

It is certified that error appears in the above-identified patent and that said Letters Patent is hereby corrected as shown below:

On the Title Page, Item (54) & Col. 1 lines 1-3
Replace the title with:

--CONTROL VALVE FOR A DEVICE FOR CHANGING THE CONTROL TIMES OF AN INTERNAL COMBUSTION ENGINE--

Signed and Sealed this

Seventh Day of July, 2009

John Doll

JOHN DOLL
*Acting Director of the United States Patent and Trademark Office*